US011818564B2

(12) United States Patent
Thigpen

(10) Patent No.: US 11,818,564 B2
(45) Date of Patent: Nov. 14, 2023

(54) QUADRUPLE TRANSDUCER

(71) Applicant: F. Bruce Thigpen, Tallahassee, FL (US)

(72) Inventor: F. Bruce Thigpen, Tallahassee, FL (US)

( * ) Notice: Subject to any disclaimer, the term of this patent is extended or adjusted under 35 U.S.C. 154(b) by 0 days.

(21) Appl. No.: 17/338,883

(22) Filed: Jun. 4, 2021

(65) Prior Publication Data

US 2022/0394412 A1 Dec. 8, 2022

(51) Int. Cl.
*H04S 7/00* (2006.01)
*H04R 1/34* (2006.01)

(52) U.S. Cl.
CPC ..... *H04S 7/302* (2013.01); *H04R 1/345* (2013.01); *H04S 7/305* (2013.01)

(58) Field of Classification Search
CPC ..... H04S 7/302; H04S 7/305; H04R 1/345
USPC ..... 381/303
See application file for complete search history.

(56) References Cited

U.S. PATENT DOCUMENTS 5,815,579 A * 9/1998 Boyden ..... H04R 3/12 381/301
2008/0063224 A1* 3/2008 De Klerk ..... H04R 1/227 381/26
2021/0058693 A1* 2/2021 Woelfl ..... H04R 1/1008
2021/0168504 A1* 6/2021 Corynen ..... H04R 1/025

* cited by examiner

*Primary Examiner* — Paul Kim
*Assistant Examiner* — Douglas J Suthers
(74) *Attorney, Agent, or Firm* — J. Wiley Horton

(57) ABSTRACT

A quadrupole transducer created by spatially offsetting a first dipole from a second dipole while causing the first and second dipoles to produce the same acoustic signal. This arrangement minimizes floor, ceiling and wall reflections which alter the perception of sound quality. In some embodiments the second dipole is vertically offset from the first dipole. This produces a phantom acoustic image that is perceived to emanate from an intermediate position.

20 Claims, 14 Drawing Sheets

QUADRUPLE TRANSDUCER

BACKGROUND OF THE INVENTION

1. Field of the Invention

This invention relates to the field of acoustics. More specifically, the invention comprises a quadrupole loudspeaker for projecting sound into a reverberant room while minimizing the effect of reflections on sound quality.

2. Description of the Related Art

Conventional prior art loudspeakers project sound into a room omnidirectionally. The sound pressure radiates from the loudspeaker and is reflected off the floor, ceiling, and walls. The signal reflections reach a listener in the room very shortly after the direct signal (often 2 to 10 milliseconds later). Because of the very short delay, the reflected signals are not perceived as reflections ("echoes") and are instead combined with the direct signal under principles of superposition. A speaker designer cannot really account for these phenomena. The combined signal contains unpredictable phase and frequency response errors since the geometry and reflective characteristics of each particular room—along with speaker position and orientation—will drive the result.

FIGS. 1-6 serve to illustrate the nature of the problems existing with prior art loudspeakers. FIG. 1 provides an elevation view of a simple prior art loudspeaker in which speaker 10 is mounted within a sealed enclosure 28. Such an arrangement acts as a monopole, in that sound energy is radiated from the front of the cone of speaker 10, but not from the back. Transducer axis 26 extends forward form the axis of symmetry of speaker 10. This represents the intended direction of sound radiation.

FIG. 2 plots sound pressure level in a polar coordinate system centered on transducer axis 26. The radius portion of the plot is logarithmic (in decibels). Relative sound pressure level ("SPL") plot 24 has a value of 0 dB along transducer axis 26 (meaning that there is no reduction compared to the maximum SPL produced by the speaker). The SPL declines as one moves away from transducer axis 26. However, the reader will note the omnidirectional nature of the sound. Even 60 degrees off transducer axis 26 the reduction in SPL is less than 3 dB. The plot highlights a significant problem with prior art loudspeakers—they project considerable sound pressure away from the transducer axis. This laterally directed pressure is reflected by the adjacent floor, ceiling, and walls.

FIG. 3 provides an elevation view of a listener 12 receiving sound from speaker 10 in an enclosed room. Direct path 18 represents the unreflected sound energy from the speaker to the listener. Floor path 20 represents the sound energy reflected by floor 14. Ceiling path 22 represents the sound energy reflected by ceiling 16. The direct path is the shortest and the sound energy following this path will reach the listener first. The floor path is usually the next most direct path. The ceiling path is usually last. Using the dimensions of a typical room, a typical speaker position, and a typical position for a standing listener, the distances for the three sound paths shown are:

Direct path—3.00 meters
Floor path—3.81 meters
Ceiling path—4.20 meters

The time for a signal to travel from the speaker to the listener along the three paths depicted is therefore:

Direct path—8.75 ms
Floor path—11.10 ms
Ceiling path—12.24 ms

From these figures the reader will discern that the "floor wave" arrives a little more than 2 ms after the direct path and the "ceiling wave" arrives about 3.5 ms after the direct path. The listener then perceives these three paths as one combined signal since the human ear tends to group together reflected sound and direct sound when the two occur within 20 ms.

Of course, in reality, the reflection phenomena are much more complex than the two-dimensional depiction of FIG. 3. FIG. 4 provides a three-dimensional depiction of a listener 32 seated in a room 30. Two separate audio channels are provided—one for right speaker 42 and one for left speaker 44. The sound energy produced by each speaker reflects off floor 14, ceiling 16, right wall 36, left wall 38, front wall 34, and rear wall 40.

The situation becomes even more complex when additional channels are present. FIG. 5 provides a plan view for a 5-channel "surround sound" system. Listener 32 is placed near the middle of the room. Sound is produced by center speaker 46, right speaker 42, left speaker 44, left rear speaker 48, and right rear speaker 50. Only some of the reflection paths are shown in the view. Many more such paths are present.

The reflection paths significantly reduce the sound quality even when only a single channel is in use. FIG. 6 provides a Fourier plot (SPL vs. frequency) of the sound received when a single speaker is present in a room with nearby reflecting walls (and floor and ceiling). The plot shows a large number of peaks and dips (in the sound pressure level, SPL) where reflections return out of phase and interfere with the direct sound arriving at the listening position. The overall sound quality is thus substantially reduced.

It is desirable to provide an electro-acoustic transducer that emphasizers the direct energy and reduces the reflected energy when placed within an enclosure—such as a typical room. The present invention provides such a solution.

BRIEF SUMMARY OF THE INVENTION

The present invention comprises a quadrupole transducer created by spatially offsetting a first dipole from a second dipole while causing the first and second dipoles to produce the same acoustic signal. This arrangement minimizes floor, ceiling and wall reflections which alter the perception of sound quality. In some embodiments the second dipole is vertically offset from the first dipole. This produces a phantom acoustic image that is perceived to emanate from an intermediate position.

REFERENCE NUMERALS IN THE DRAWINGS

Figure 1:
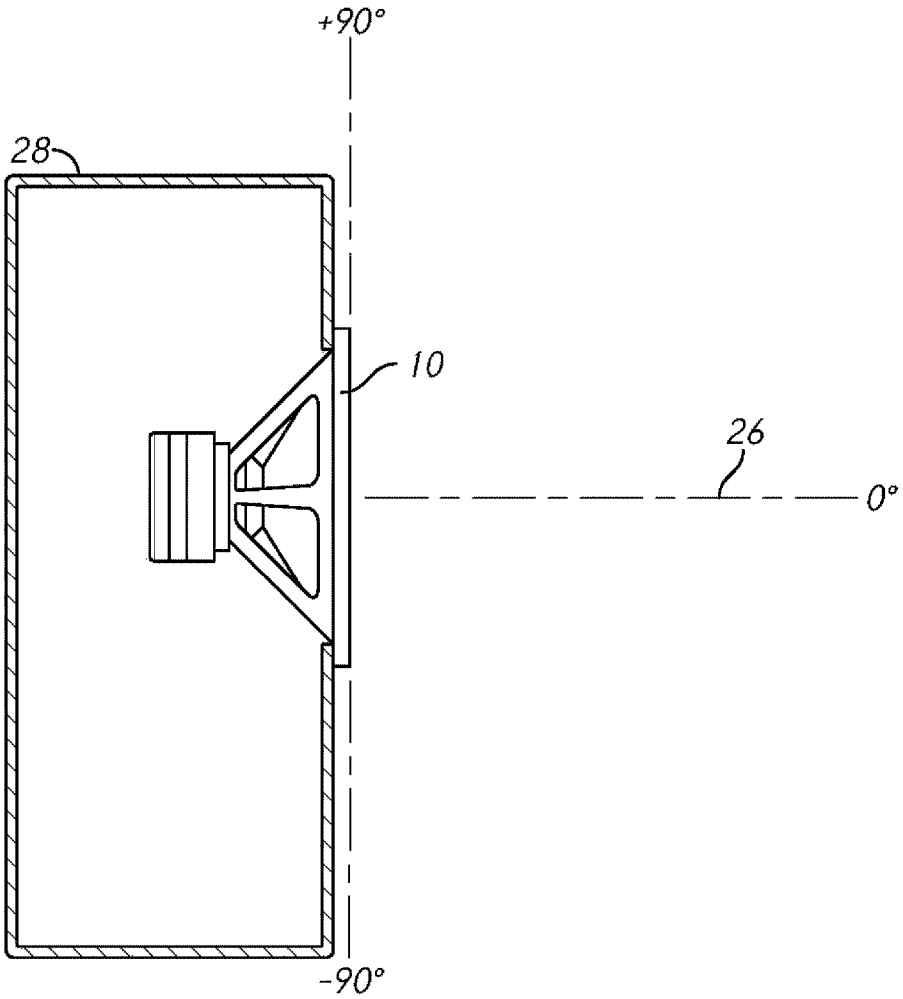
FIG. 1 (PRIOR ART)
FIG. 1 is a sectional elevation view, showing a prior art speaker and enclosure.

10 speaker
12 listener
14 floor
16 ceiling
18 direct path
20 floor path
22 ceiling path
24 relative SPL plot
26 transducer projection axis
28 enclosure
30 room
32 listener
34 front wall
36 right wall
38 left wall
40 rear wall
42 right speaker
44 left speaker
46 center speaker
48 left rear speaker
50 right rear speaker
52 Fourier plot
54 dipole transducer
56 chassis
58 mounting trunnion
60 diaphragm
62 quadrupole transducer
64 mounting frame
66 right quadrupole transducer
68 left quadrupole transducer
70 Fourier plot
72 horizontal axis
74 positive elevation
76 negative elevation
78 Fourier plot
80 pinna notch
84 transducer projection axis
86 transducer projection axis
86 Fourier plot
88 Fourier plot
90 video display
92 dipole transducer
93 signal input
94 input signal line

DETAILED DESCRIPTION OF THE INVENTION

Figure 2:
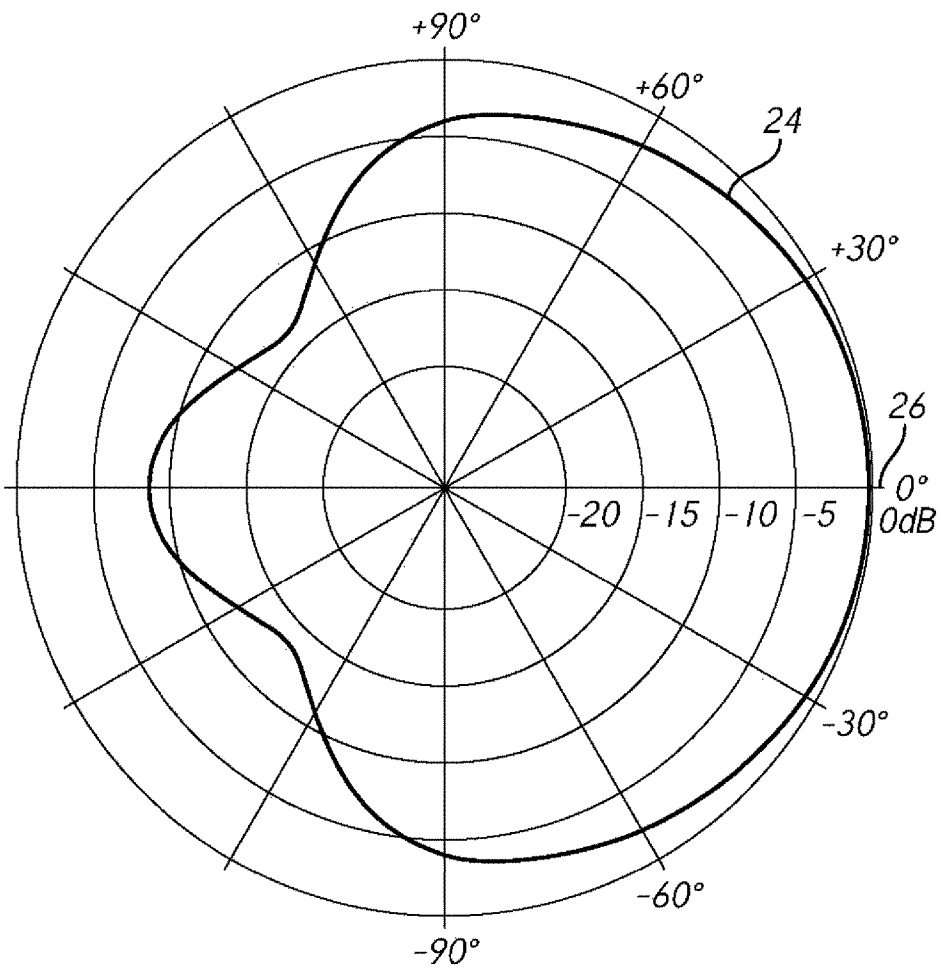
FIG. 2 (PRIOR ART)
FIG. 2 is a polar plot of sound pressure level and angular position for a prior art loudspeaker.
Figure 3:
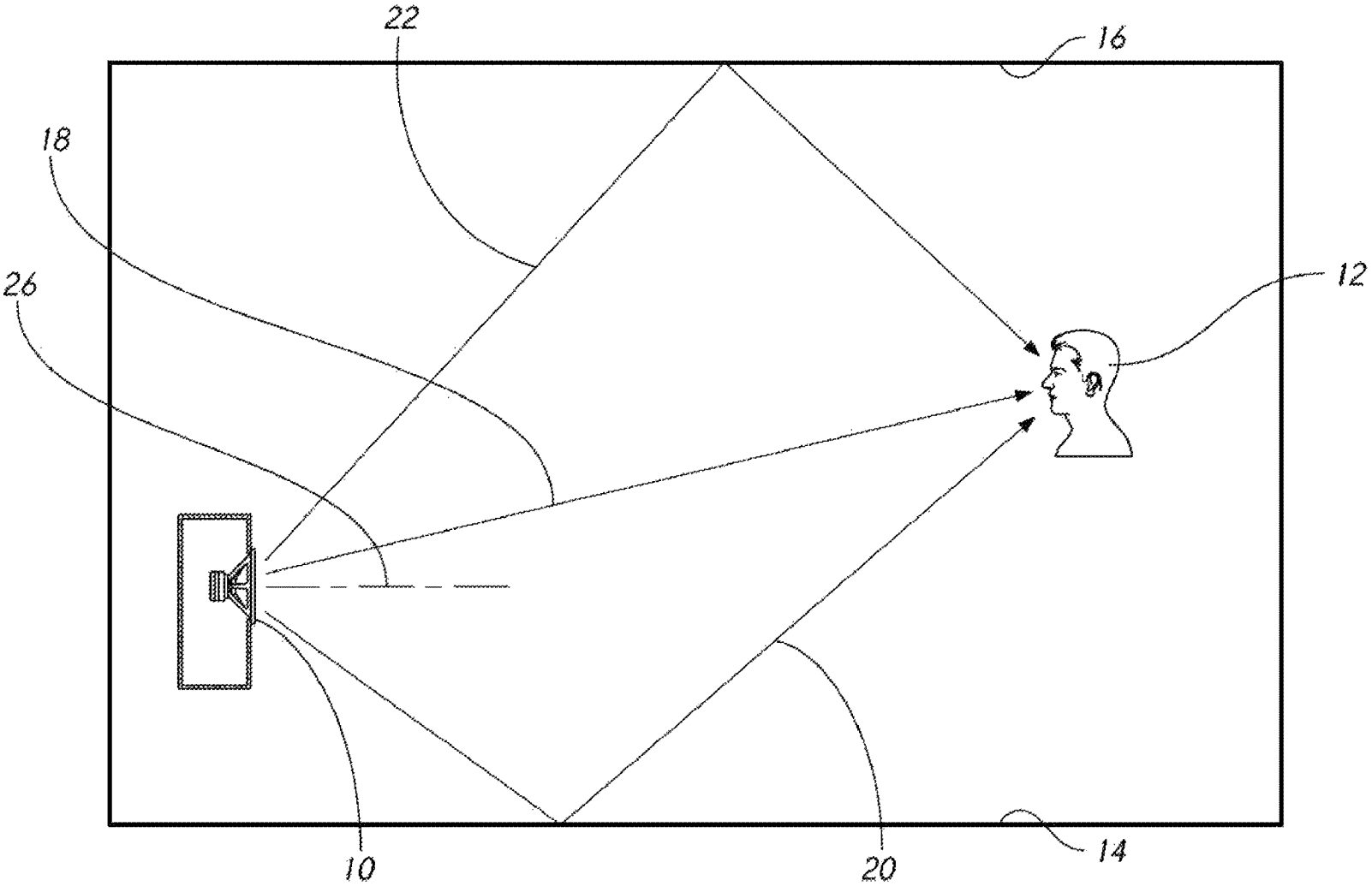
FIG. 3 (PRIOR ART)
FIG. 3 is an elevation view depicting multiple paths from a prior art speaker to a listener.
Figure 4:
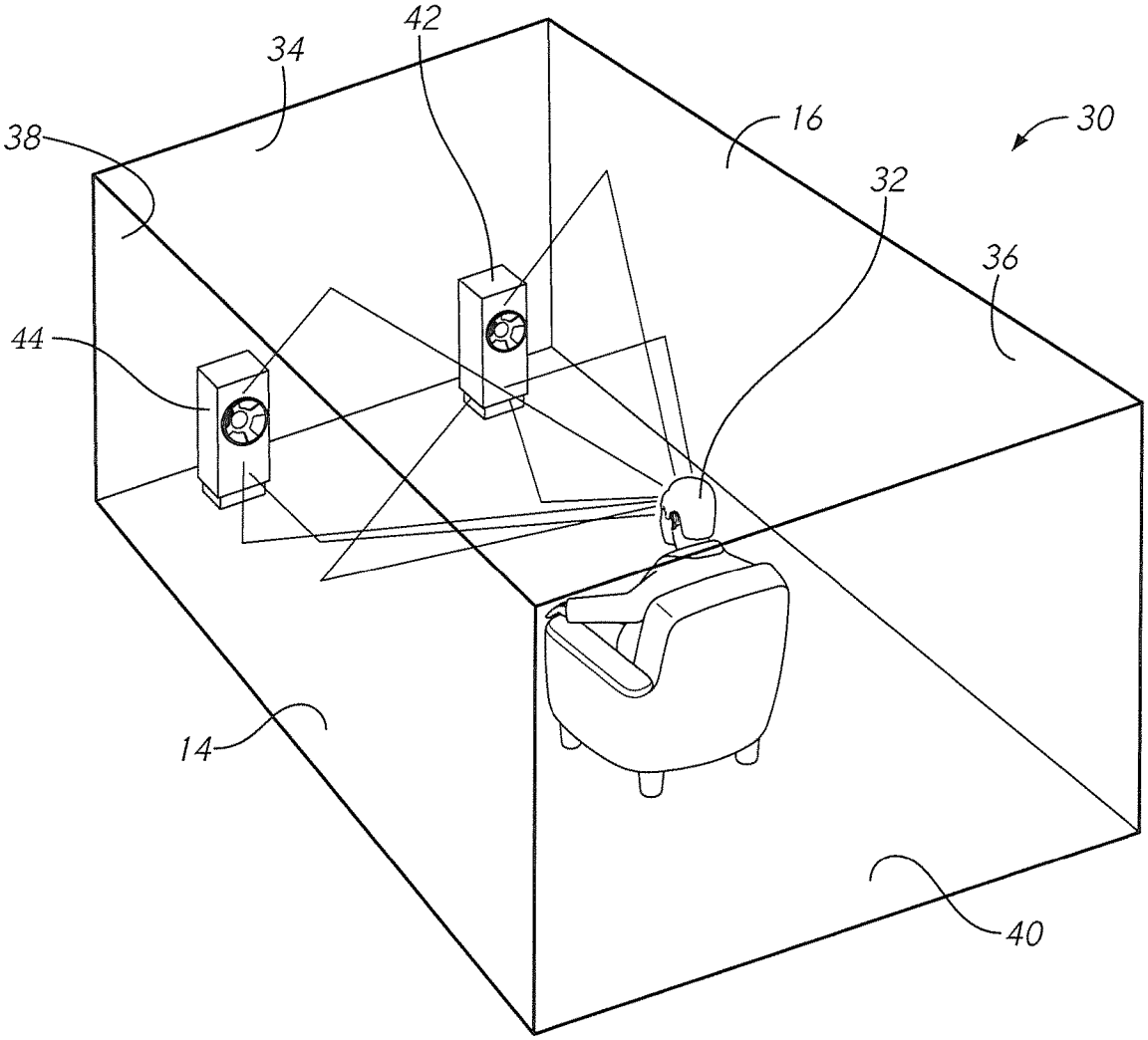
FIG. 4 (PRIOR ART)
FIG. 4 is a perspective view, depicting multiple paths from a pair of prior art speakers to a listener.
Figure 5:
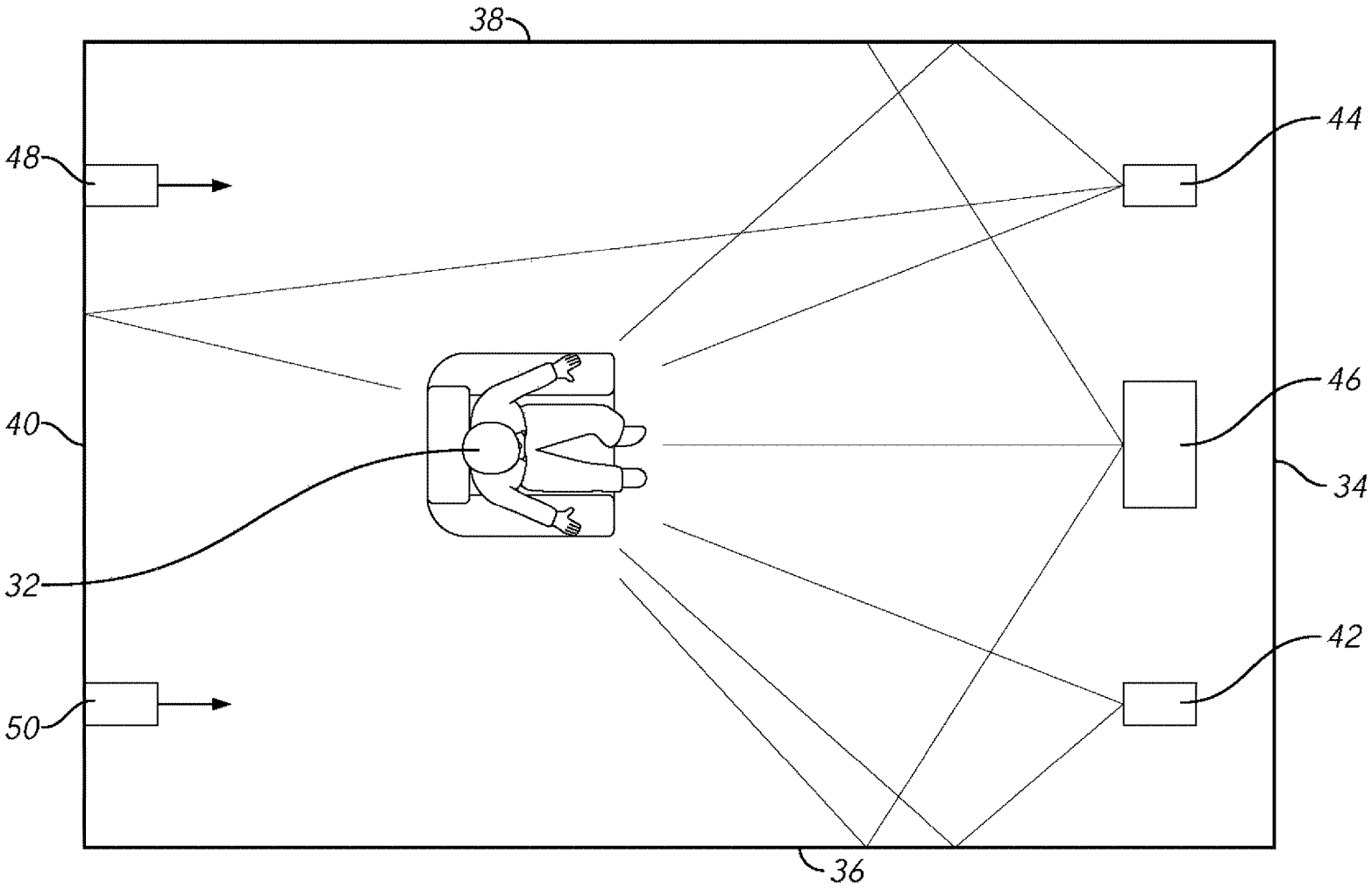
FIG. 5 (PRIOR ART)
FIG. 5 is a plan view, depicting multiple paths from a five-channel sound system to a listener.
Figure 6:
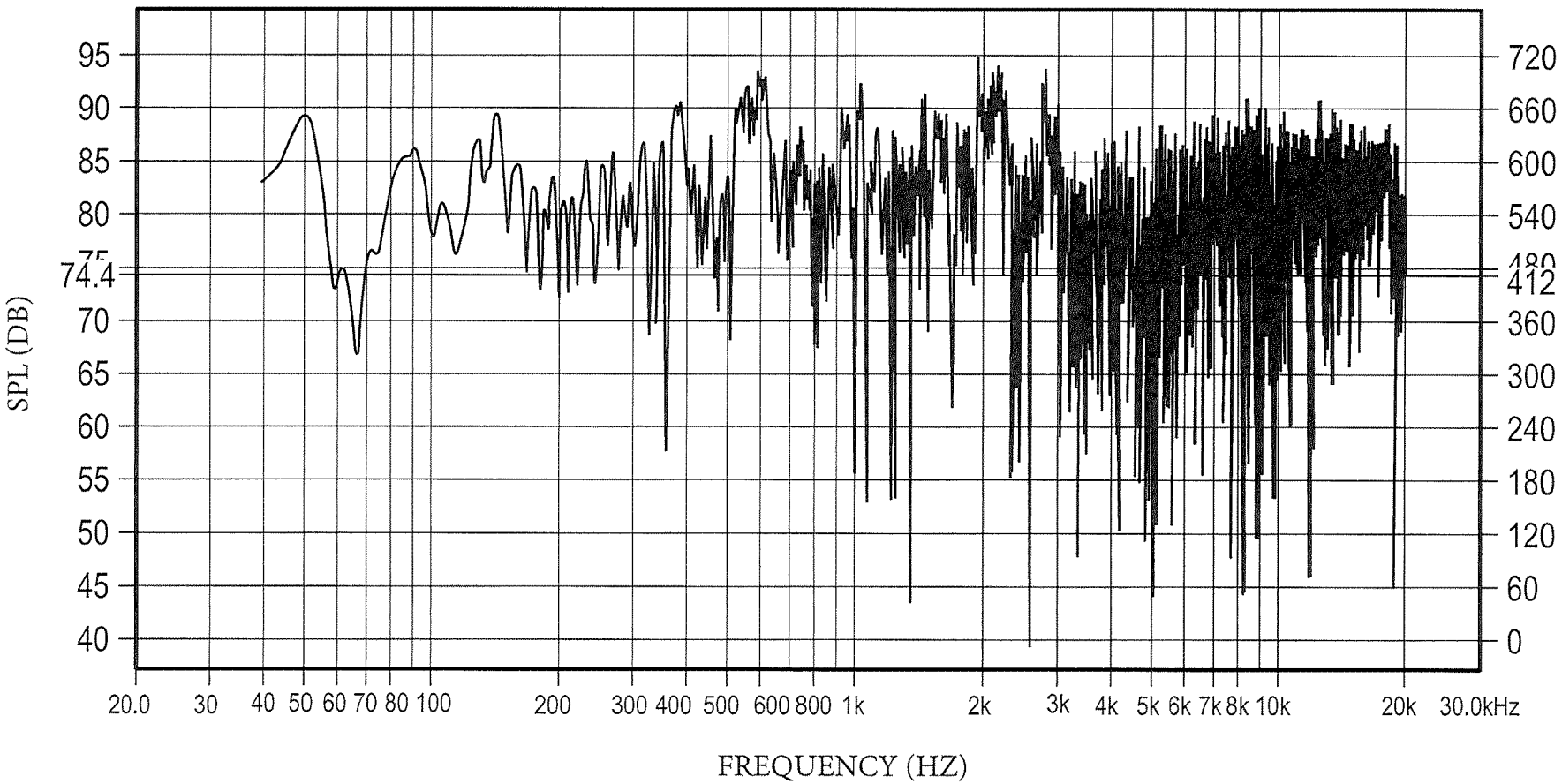
FIG. 6 is a Fourier plot for sound produced by a prior art loudspeaker and reflected off the adjacent floor, ceiling, and walls.

The simplified depiction of FIG. 3 serves well to illustrate the problem in the prior art. Prior art speakers are designed to project sound energy out along the transducer projection axis 26. In the example shown the transducer projection axis is nearly aligned with direct path 18 to listener 12. However, the prior art speaker 10 also projects considerable sound energy outward in unwanted directions far away from the projection axis 26. FIG. 2 ably demonstrates this point. Even 60 degrees away from projection axis 26 the sound pressure level ("SPL") is only about 2 dB below the SPL on the projection axis itself. This fact means that the direct path signal is only slightly stronger than the multiple reflected path signals.

Figure 7:
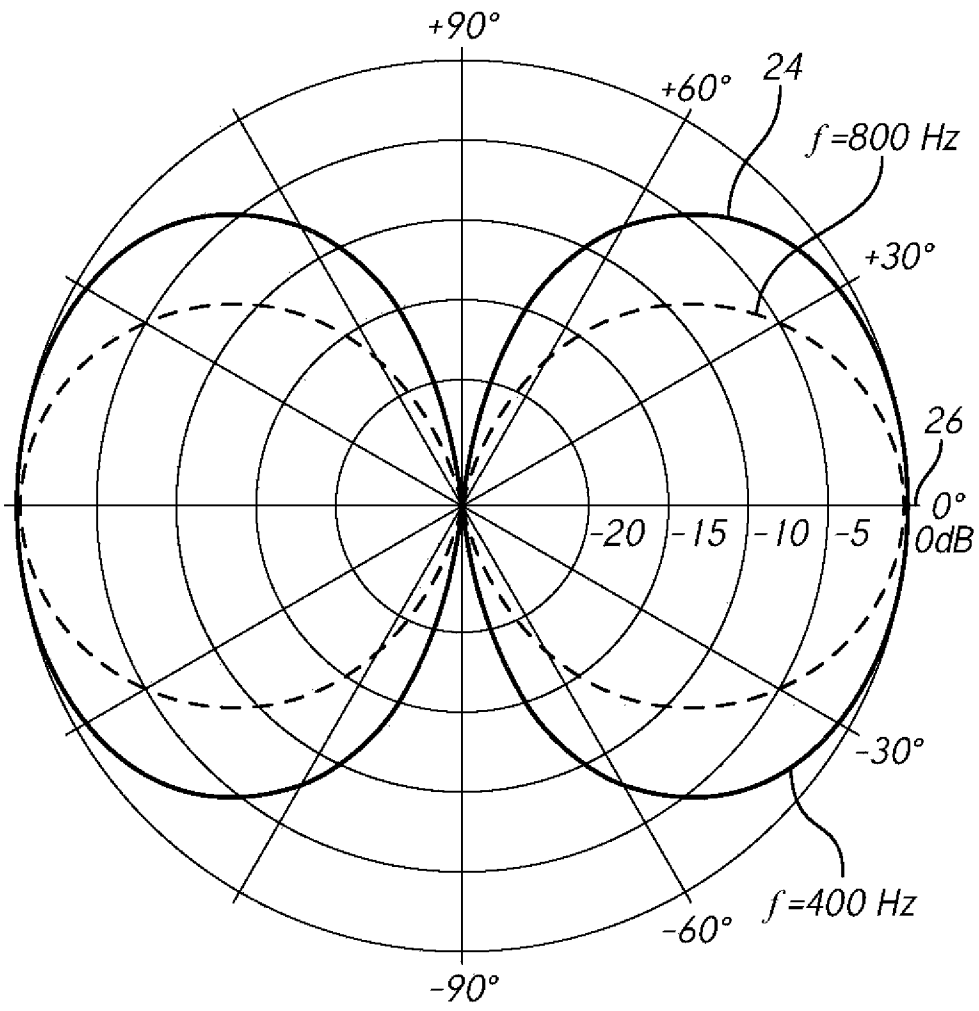
FIG. 7 is a polar plot of sound pressure level and angular position for a dipole transducer such as used in the present invention.

A more directional loudspeaker is needed. Acoustic dipoles have a much more directional sound projection. FIG. 7 shows a polar sound pressure level plot for an exemplary dipole. SPL is highest along transducer axis 26 and 180 degrees away from transducer axis 26. This distribution is inherent in the nature of a dipole. Sound is radiated equally from each side of the dipole, but in opposite phase. In looking at FIG. 7 the reader will note that SPL falls away sharply when traveling away from transducer axis 26. The distribution depends upon the frequency of the sound emitted. The plot of FIG. 7 shows two exemplary frequencies—400 Hz and 800 Hz. For the 400 Hz curve, the SPL has fallen more than 5 dB at 60 degrees off the transducer axis 26. At 75 degrees off the transducer axis the SPL has fallen well over 10 dB. The directional variation is even greater for the 800 Hz signal. At 60 degrees off the transducer axis the SPL for the 800 Hz signal the SPL has fallen over 15 dB. For higher frequencies the directionality of the dipole transducer becomes even greater.

Figure 8:
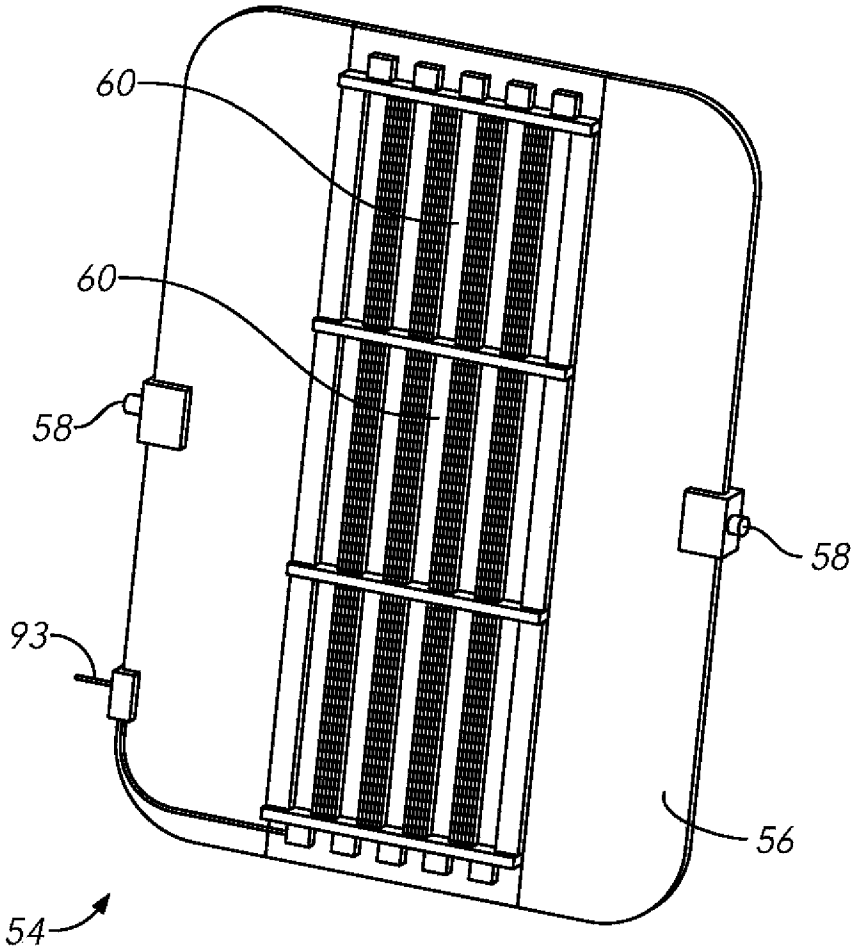
FIG. 8 is a perspective view, showing a dipole transducer such as used in the present invention.

An electro-acoustic dipole can be physically realized in a variety of ways. FIG. 8 shows one such physical embodiment. Chassis 56 mounts diaphragm 60. The diaphragm is a flat, flexible thin-film diaphragm. Elongated strips of magnetic material are secured on both sides of this flexible diaphragm. Conductors attach to the diaphragm extend primarily parallel to the magnetic strips and cause movement of the diaphragm when excited electrically. Signal input 93 receives an external electrical signal and feeds it to the conductors on the diaphragm. Thus, dipole transducer 54 receives electrical signals and converts them to sound signals via motion of the diaphragm.

Chassis 56 extends outward from the boundary of the diaphragm in the same plane as the diaphragm. The chassis serves several functions. First, it physically provides a rigid mount for the diaphragm and its associated hardware. Second, it provides a barrier to limit phase cancellation between the front and rear sides of the diaphragm.

As those skilled in the art will know, the moving diaphragm creates an acoustic dipole. If it is electrically excited to create a positive sound pressure wave from the surface of the diaphragm facing the viewer in FIG. 8, the diaphragm surface facing away from the viewer will produce an equal negative sound pressure wave. Stated another way, the front-side and back-side waves will have equal amplitude but will be 180 degrees out-of-phase. The planar barrier provided by portions of chassis 56 reduces the tendency of sound pressure to "sneak around" the perimeter of the device and cause phase cancellation. More detailed information regarding the operation of dipole transducer 54 is provided in my own U.S. Pat. No. 4,837,838. U.S. Pat. No. 4,837,838 is hereby incorporated by reference.

Suitable mounting hardware is preferably provided for dipole transducer 54. This can assume many forms. In the example of FIG. 8, a mounting trunnion 58 is provided on each side. These mounting trunnions allow the dipole to be attached to a mounting frame and then tilted as desired.

Figure 9:
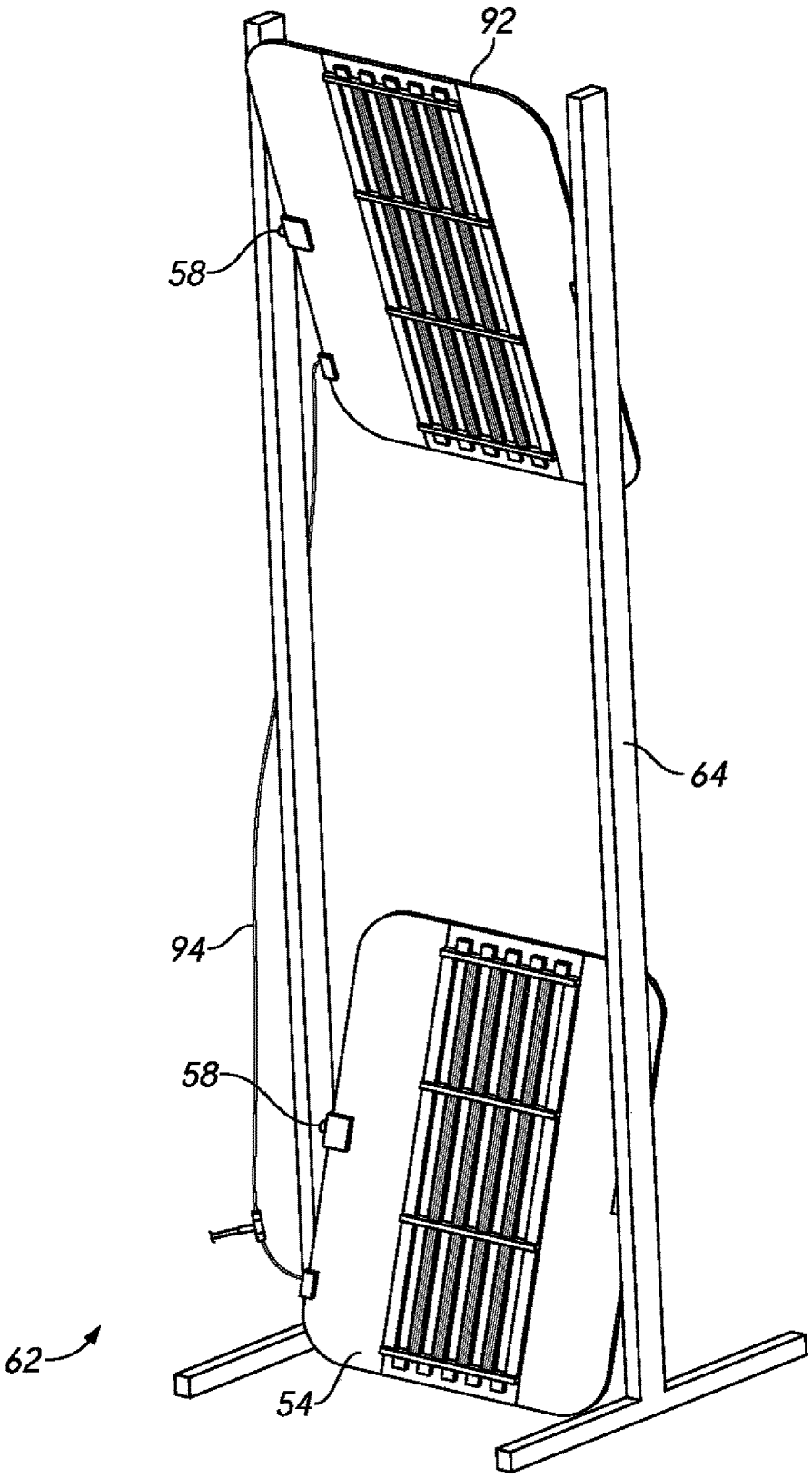
FIG. 9 is a perspective view, showing an assembly of two of the dipole transducers of FIG. 8 into a quadrupole.

The present invention uses two dipoles mounted in a specific arrangement to create a quadrupole. FIG. 9 shows an exemplary mounting system. Dipole transducer 54 (as shown in FIG. 8) is mounted to a lower portion of mounting frame 64. A second, identical dipole transducer 92 is also mounted to mounting frame 64. Dipole transducer 92 is vertically offset from dipole transducer 54 as shown. The assembly shown is collectively referred to as quadrupole transducer 62.

The same electrical signal feeds both dipole transducers 54,92. In the example shown, the electrical signal is carried on input signal line 94 to both dipole transducers. The common electrical signal can be provided to the dipole transducers in other ways—such as using wireless connections. In any event, however, the signal produced by the two dipole transducers should be the same signal and it should be matched in time (phase matched). The signal is preferably also matched in amplitude though this could be made adjustable within a small range.

Figure 13:
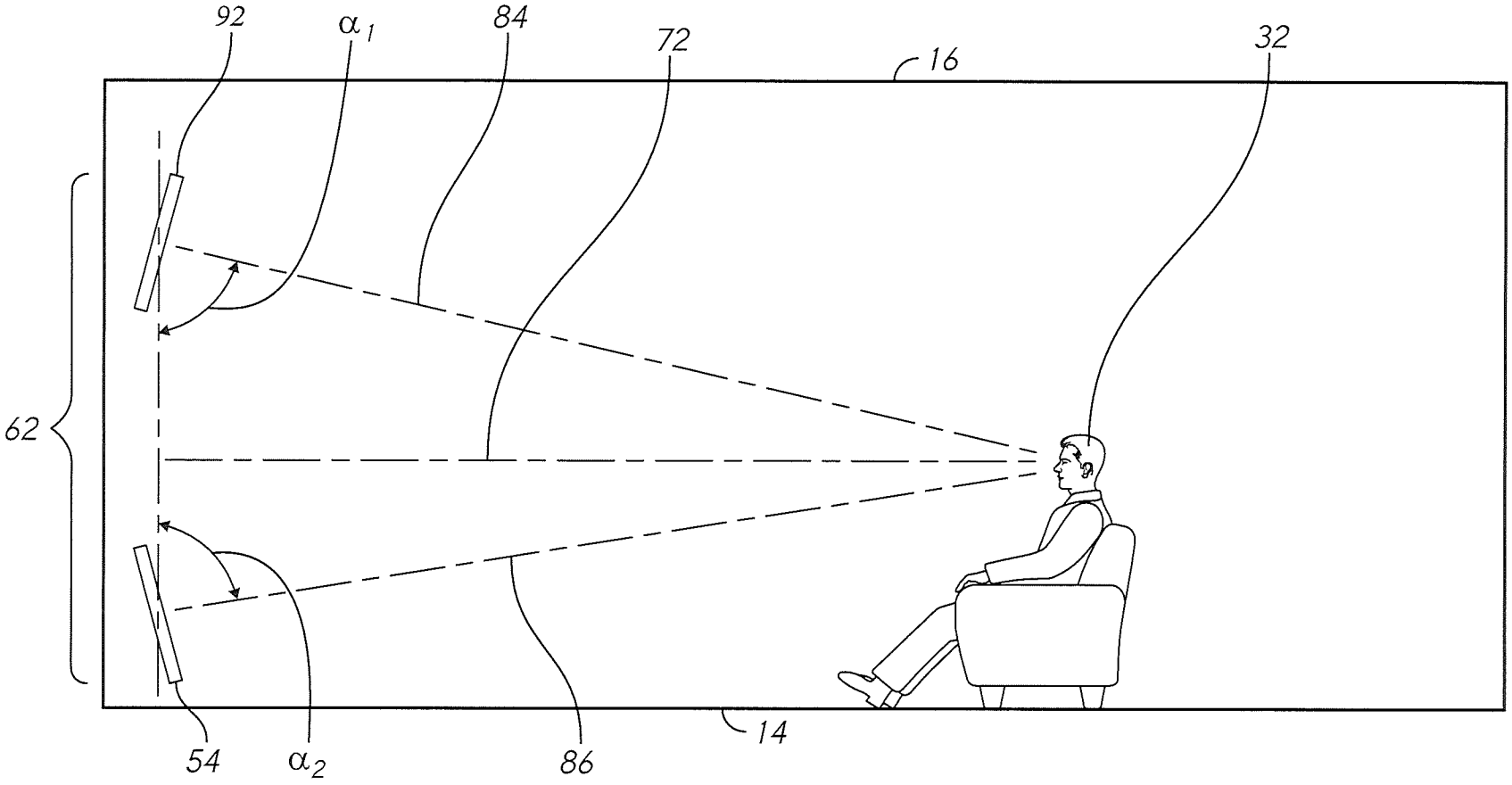
FIG. 13 is an elevation view, showing how the quadrupole transducer can be focused on a desired listening point.

The mounting trunnions provided allow the two dipole transducers to be tilted to a desired degree and then locked in place. The ability to tilt the dipoles is preferred. FIG. 13 illustrates a reason for this. FIG. 13 provides a side elevation view of a room in which quadrupole transducer 62 has been installed. A preferred position for the head of listener 32 is established.

Each dipole transducer has a transducer projection axis that is normal to the plane of the diaphragm. Dipole transducer 92 has a transducer projection axis 84 extending as shown. Likewise, dipole transducer 54 has a transducer projection axis 86. For visual reference, a vertical axis 82 is projected up through the dipole transducers. Horizontal axis 72 lies in a horizontal plane passing through the listening position. Dipole transducer 92 is titled so that its transducer projection axis 84 lies at an angle $\propto_1$ with respect to vertical axis 82. Likewise, dipole transducer 54 is titled so that its transducer projection axis 86 lies at an angle $\propto_2$ with respect to vertical axis 82. The angles are selected so that transducer projection axis 84 and transducer projection axis 86 intersect proximate the listening position (in this case the head of listener 32). The word "proximate" is used because the intersection does not have to be precise to be effective. Preferably the intersection occurs within 1.5 meters of the listening position and even more preferably within 0.5 meters of the listening position.

The reader will recall the radiation characteristics of each of the two dipoles from FIG. 7. Both project sound energy along the axes 84,86 but much less sound energy in the perpendicular direction. In looking at the geometry of FIG. 13, this means that the reflected energy from floor 14 and ceiling 16 will be much less than the energy projected along axes 84,86. In addition, since the two transducers 54,92 are producing the same signal, that signal will be summed at the listening position. The result is that the direct sound signal heard by the listener will be much stronger than the reflected sound signals.

Figure 10:
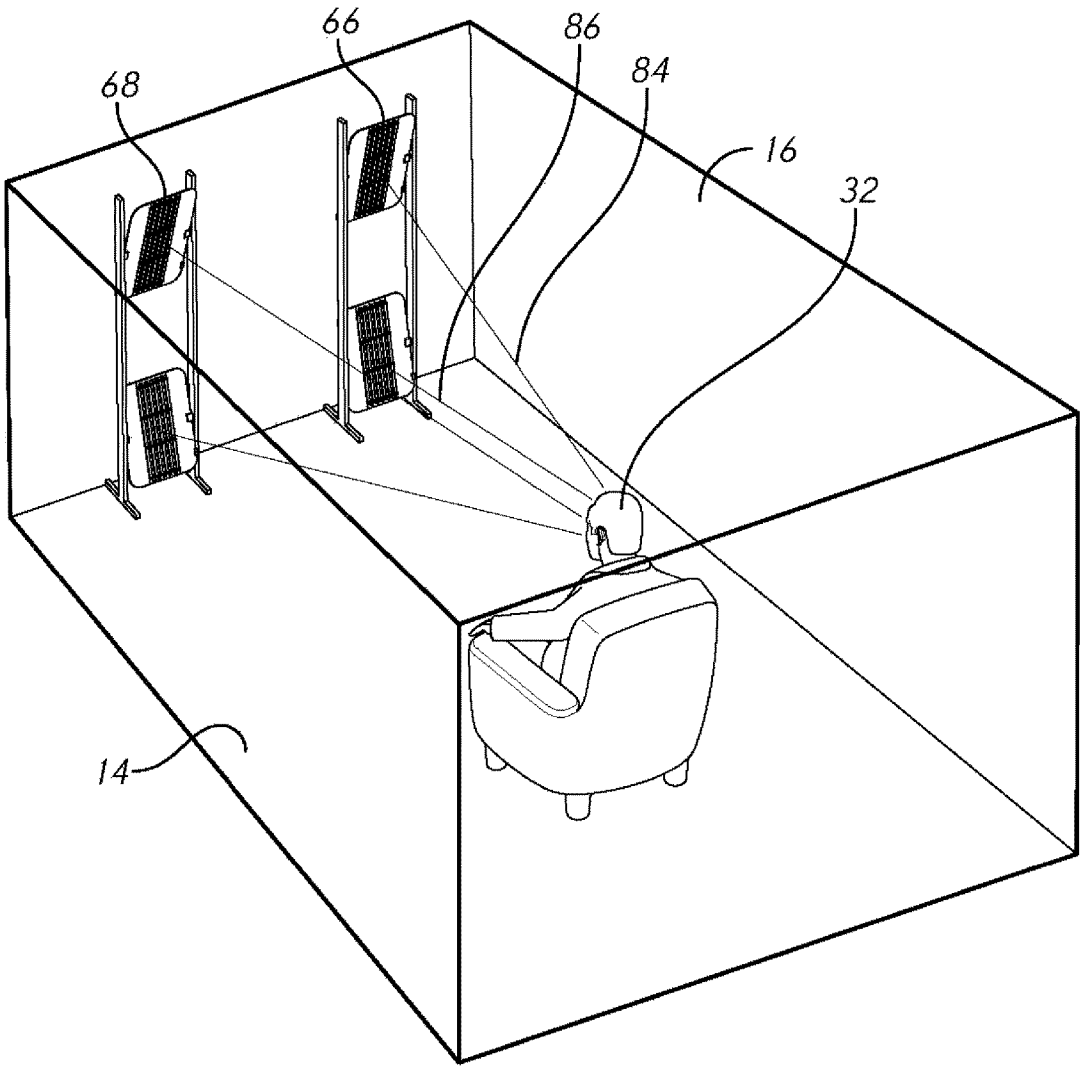
FIG. 10 is a perspective view, showing the use of a pair of quadrupole transducers in a room.

FIG. 10 shows the inventive quadrupole transducer used in a two channel ("stereo") system. Right quadrupole transducer 66 is used for the right channel of a two-channel audio source, while left quadrupole transducer 68 is used for the left channel. The transducer projection axes 84,86 for each quadrupole converge on the listening position as shown.

Each dipole in each quadrupole is tilted to provide the desired convergence of the transducer projection axes in the vertical plane. It is also possible to swivel the quadrupoles slightly (azimuth correction) so that the projection axes converge in the horizontal plane. This is actually shown in FIG. 10. However, the amount of swivel needed is quite small and leaving the transducers parallel does not introduce significant error.

Figure 11:
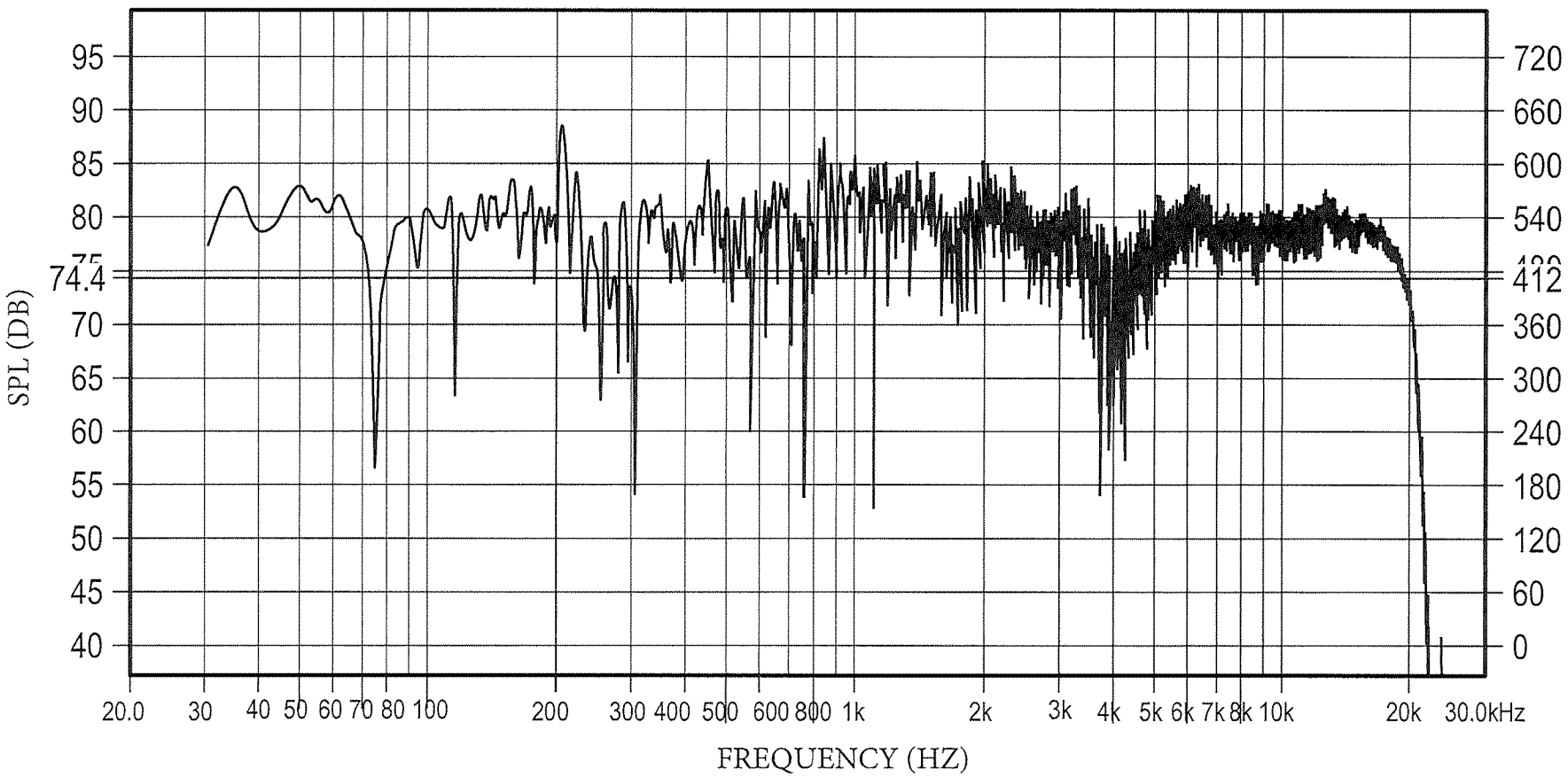
FIG. 11 is a Fourier plot for a quadrupole speaker in the same room depicted for the prior art speaker in FIG. 6.

FIG. 11 shows a Fourier plot 70 of an audio signal from a single quadrupole transducer—sampled at the listening position. The quadrupole effectively removes the floor, ceiling, and side wall first reflections to extend the time for very early reflections out to between 10 and 20 ms (depending on the size of the room). Reduced early reflections improve the ability to localize sound between the speaker channels.

Because the quadrupole sums at the listener, there is an effective increase in transducer efficiency. Acoustic energy is not wasted filling the room. Sound pressure at the listener is actually higher than the sound pressure radiated from any individual transducer in the sound system.

Most prior art audio systems produce fundamental and large errors. In particular, they produce large frequency response errors induced by the room if not by the speaker itself. A near field anechoic or gated frequency response measurement has been used as the primary quality indicator of a loudspeaker. But what a human listener actually hears is the tonal balance from the sound power which depends on the room and how energy radiated from a speaker interacts with the room (especially the multiple reflective paths). Even though the on-axis response of a prior art speaker may be flat, sound power defines the perceived tonal balance of a loudspeaker. Only a modest correlation between frequency response and loudspeaker quality can be derived from a near field frequency response measurement for a prior art speaker. On the other hand, the inventive quadrupole provides a more significant correlation between measured response at the listening position and a listener's perceived tonal balance by removing early reflections.

Returning to FIG. 9, another aspect of the inventive quadrupole 62 will be explained. The reader will recall that the upper dipole 92 and lower dipole 54 are vertically offset from each other (One dipole is located significantly above the other). However, because the two dipoles transmit the same signal, an acoustic "phantom image" is created in the perception of the listener. The user perceives the two dipoles as a single source located in between the position of the two dipoles.

Figure 12:
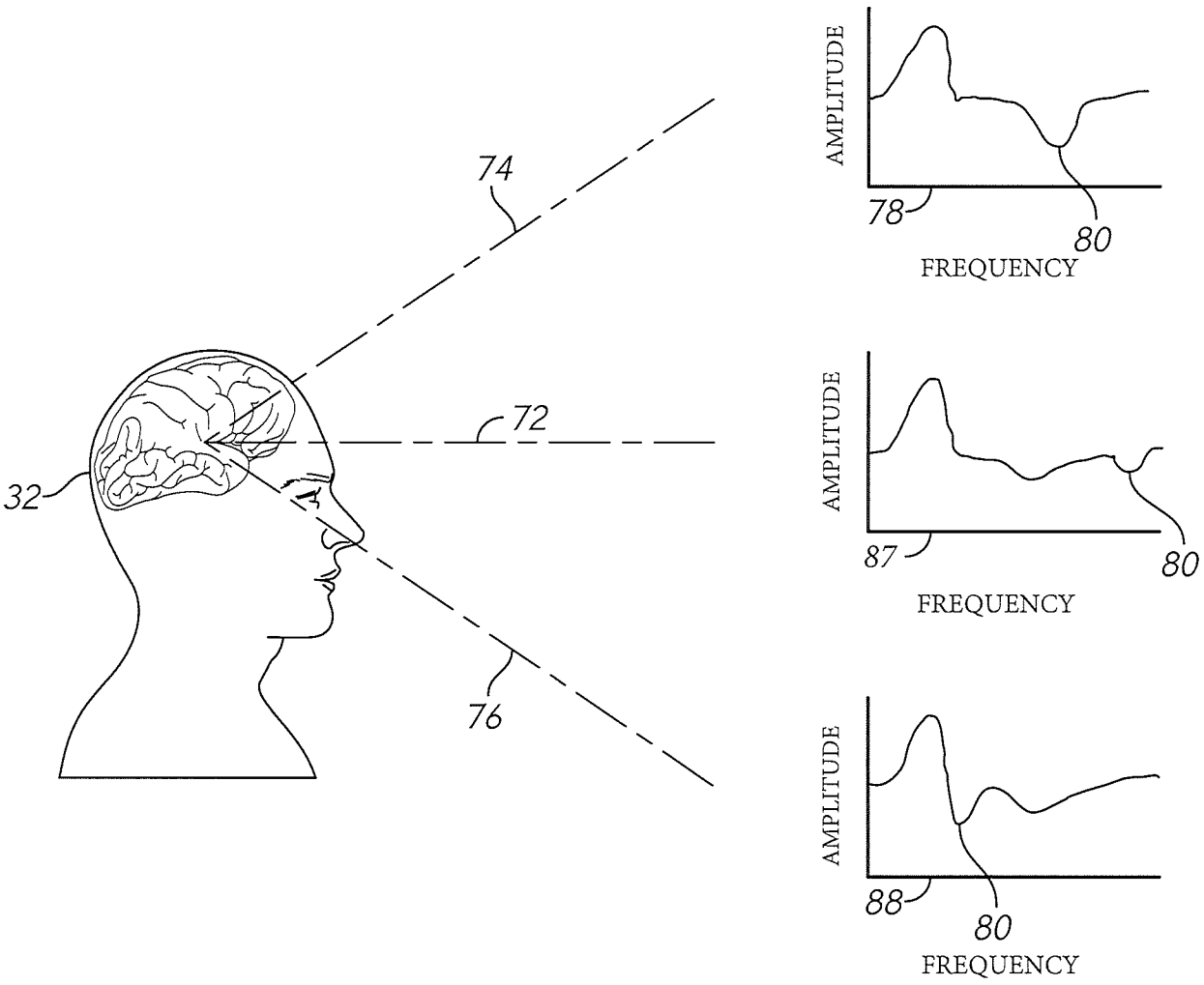
FIG. 12 is an elevation view, depicting the head-related transfer response in human hearing.

FIG. 12 serves to explain this phenomenon further. First, however, a brief explanation of how the human brain localizes the source of a sound is helpful. Scientists studying these phenomena customarily use a polar coordinate system centered on the user's head. Sound localization is stated in terms of azimuth, elevation, and range. The zero azimuth axis proceeds in the posterior horizontal direction from the user's head. Azimuth values are stated in degrees to the right or left of this zero-azimuth axis. Elevation values are stated in degrees above the horizontal. Thus, providing azimuth and elevation gives a scalar for a particular sound source. A range value is then stated as a distance along that scalar (resulting in a vector).

Human sound source localization depends upon three perception cues. The first two cues are binaural—meaning they use both ears. The first cue is interaural time difference. This is the perception of delay between the time a first ear perceives a sound and the second ear perceives the same sound. This interaural time difference is primarily used to determine azimuth, and it is remarkably accurate for many directions. It is not accurate for sound sources lying close to an axis drawn between the two ears. A "cone of confusion"

exists on both sides of the head along this axis, and interaural time difference does not resolve position well within this region.

The second cue is interaural level difference—the difference in sound pressure level perceived by the two ears. To a large extent this second binaural cue resolves the problem inherent in the first binaural cue. A listener can perceive that a sound source lying within the cone of confusion on the right side of the head is in fact on the right side of the head because the right ear perceives the sound to be much louder than the left. The combination of the interaural time difference cue and the interaural level difference cue allows the human brain to determine the azimuth of a sound source.

The determination of elevation is a more subtle process. The outer portion of the human ear is usually called the auricle or the pinna. These terms are synonyms and the term pinna will be used in this disclosure. The pinna has complex sound gathering and altering features. This is also true of the human anatomy more broadly surrounding the pinna. For the purposes of sound localization, the relevant anatomy includes the pinna, head, shoulders, and chest. This anatomy reflects and gathers sound in complex ways that are—in many respects—unique to the individual. More importantly, the frequency distribution of these gathered signals varies with the elevation of the sound source.

FIG. 12 graphically depicts the human brain's process of determining elevation for a sound source. Horizontal axis 72 represents the zero-elevation axis. Positive elevation axis 74 represents a vector to a sound source lying well above the user. Negative elevation axis 76 represents a vector to a sound source lying well below the user. To the right are three plots with the frequency on the X-axis and the amplitude on the Y-axis (often called a "Fourier plot"). The upper Fourier plot 78 represents the frequency distribution of the sound fed to the user's ear for a sound source lying on positive elevation axis 74. The reader will note a distinct "notch" in the amplitude near the middle of the frequency spectrum. This notch is referred to as the "pinna notch" (pinna notch 80) though it is the result of more anatomy than just the pinna alone. The notch means that the ear hears sounds within that frequency band at a significantly reduced amplitude.

In contrast, Fourier plot 88 represents the frequency distribution of the sound fed to the user's ear for a sound source lying on negative elevation axis 76. This plot also contains a notable pinna notch 80, but the reader will observe that the notch has shifted to the left (a lower frequency) in comparison to the notch location for the upper Fourier plot 78.

Fourier plot 86 represents the frequency distribution for a sound source lying on horizontal axis 72. This plot also contains a pinna notch 80, though it is less pronounced. The pinna notch for sounds lying along the horizontal axis is shifted to the right (a higher frequency).

The structure of the pinna and other relevant portions of the human anatomy perform a form of frequency-based sound filtering which is highly dependent upon the elevation of the sound source. The human brain uses the location of the pinna notch to determine the elevation of a sound source. This process is sometimes referred to as the "head related transfer function." The implication of that term is that the human brain unconsciously performs a transformation from the frequency domain to the spatial domain. This is not understood to be a mathematical function like a Fourier transform. More likely the brain "maps" the relationship between the frequency information and observed spatial information and learns this relationship over time. In fact, researches have affixed artificial enlarged pinna to the human ears and have noted the brain's ability to "map" this new pinna geometry in a few days while still retaining the ability to rapidly revert to the original mapping of the biological pinna when the artificial pinna is removed.

In looking at the upper Fourier plot 78 and the lower Fourier plot 88, one skilled in the art will realize that if you sum the two signals then the pinna notch will be removed—or in any case made much less pronounced. The result is a frequency distribution much like Fourier plot 86, which the listener will perceive as a sound source lying along the horizontal axis.

Looking now at FIG. 13, a significant implication of the quadrupole transducer will become apparent. Dipole transducer 92 and dipole transducer 54 both produce the same signal. Dipole transducer 92 lies above the listener and that signal will be perceived as containing a pinna notch like the upper plot in FIG. 12. Dipole transducer 54 lies below the user and that signal will be perceived as containing a pinna notch like the lower plot in FIG. 12. However, the two signals are summed at the position of listener 32 and the notches are removed by the summing process. The result is the creation of a "phantom acoustic image" which the listener perceives as lying on horizontal axis 72. Listener 32 does not perceive that sound is coming from two separate sources. Instead, listener 32 perceives only a single source lying on horizontal axis 72.

Figure 14:
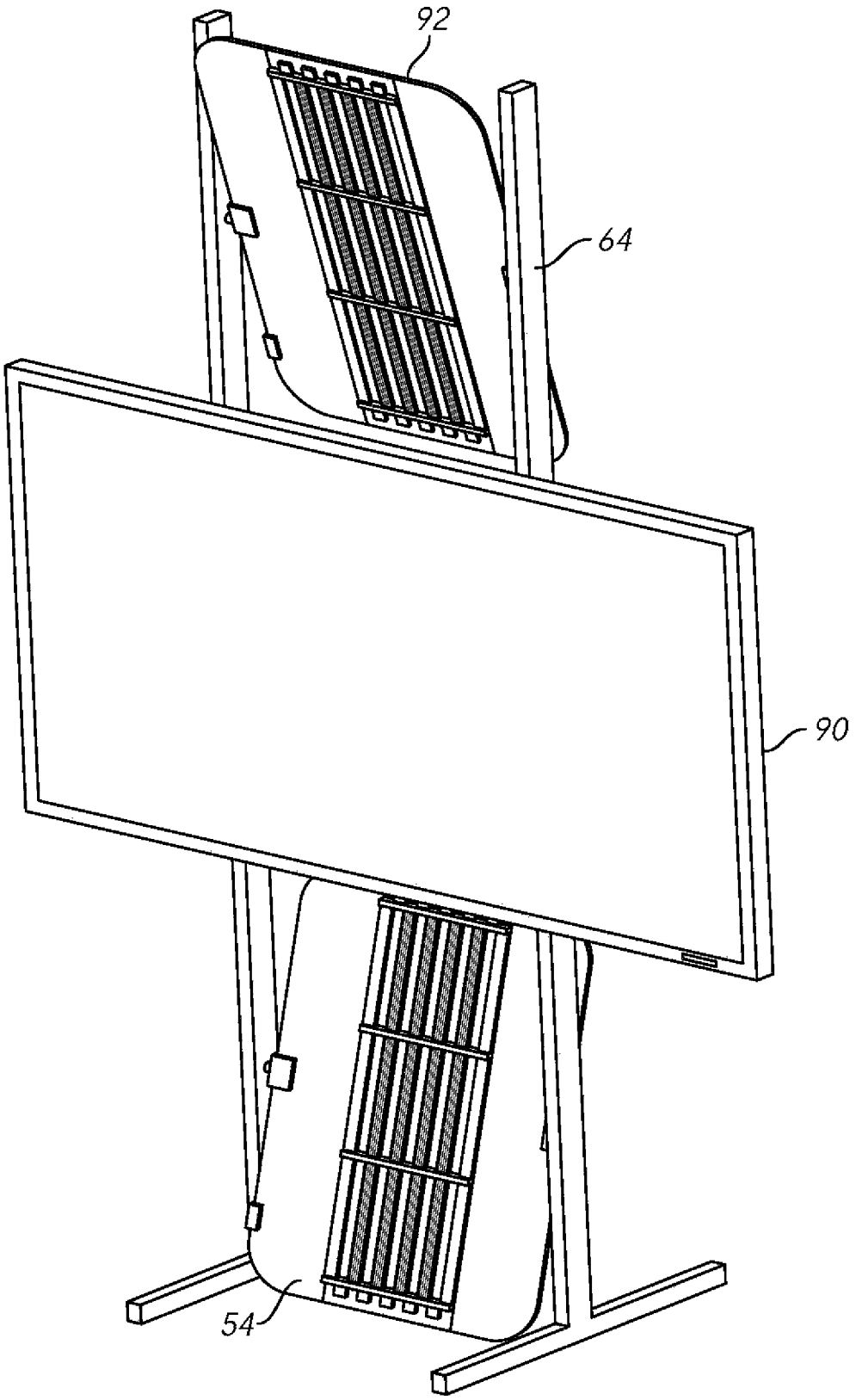
FIG. 14 is a perspective view, showing a quadrupole transducer being used as a center speaker in conjunction with a video display.

The creation of the phantom acoustic image is advantageous in many situations. FIG. 14 presents one advantageous application. In this assembly the quadrupole transducer is used to project the sound image corresponding to a video image displayed on video display 90. Dipole transducer 92 is placed above the video display and dipole transducer 54 is placed below. The two in conjunction produce the phantom acoustic image described previously, with the phantom acoustic image being centered on video display 90. A user watching the video and listening to the sound produced will perceive that the sound is coming from video display 90. This can be used as the sole audio source associated with video display 90. It can also be used as the center channel for a multi-channel audio system associated with the video display (often referred to as a 5-channel "surround sound" system).

The assembly of FIG. 14 ably shows the position of the components but is not visually pleasing. In such an installation video display 90 will often be attached to a wall. The two dipole transducers 54, 92 can be placed in small cavities within the wall and hidden behind speaker cloth. Alternatively, the two dipole transducers can be contained within small enclosures that are mounted to the wall.

Many other variations and combinations will occur to those skilled in the art. These include the following.

1. The combination of two dipoles fed by the same signal to produce a quadrupole has been shown with a vertical offset between the two dipoles. A horizontal offset can just as easily be used. Thus, for the version of FIG. 14, the two dipoles 54,92 could be located on either side of video display 90 and still produce the phantom acoustic image centered on video display 90. The user of a vertical offset is advantageous, however, when presenting left and right stereo channels as in the arrangement of FIG. 10.

2. The use of a vertical offset between the two dipoles—as depicted in FIG. 13—does not mean that the offset has to be perfectly vertical. It is important for the two direct (unreflected) signals from the dipoles 54, 92 to reach listener 32 without a significant time difference. Thus, the distance from dipole transducer 54 to the listener and the distance from dipole transducer 92 to the listener should be about the same. However, if one dipole is 10 cm closer to the user this will only introduce a 0.3 millisecond time difference. Such a short time difference will not significantly degrade the sound quality of the quadrupole. Thus, the inventive quadrupole is forgiving of some errors in the spacing of the two dipoles. The vertical offset between the two dipoles should be understood to be preferably within 20 degrees of vertical and even more preferably within 10 degrees of vertical.

3. The same flexibility holds for the embodiments using a horizontal offset between the dipoles. The offset does not need to be perfectly horizontal. In fact, for both vertical and horizontal offsets, the offset can be far from perfect so long as the distance from each dipole to the defined listening position is about the same.

4. The embodiments depicted have used a planar dipole transducer—such as shown in FIG. 8. Other types of dipole transducers can be used, as long as they exhibit sound distribution characteristics similar to those depicted in FIG. 7.

The preceding description contains significant detail regarding the novel aspects of the present invention. They should not be construed, however, as limiting the scope of the invention but rather as providing illustrations of the preferred embodiments of the invention. Thus, the scope of the invention should be fixed by the following claims, rather than by the examples given.

What is claimed is:

1. A loudspeaker for use by a listener in a listening position, comprising:

(a) a first dipole transducer, having a first projection axis;

(b) a second dipole transducer, having a second projection axis;

(c) said second dipole transducer being vertically offset from said first dipole transducer;

(d) said first and second dipole transducers being driven by a single electrical signal;

(e) said listening position being horizontally offset from said first and second dipole transducers;

(f) said first dipole transducer being tilted with respect to a vertical axis and said second dipole transducer being tilted with respect to a vertical axis so that said first projection axis and said second projection axis intersect proximate said listening position.

2. The loudspeaker for use by a listener in a listening position as recited in claim 1, further comprising:

(a) a third dipole transducer, having a third projection axis;

(b) a fourth dipole transducer, having a fourth projection axis;

(c) said fourth dipole transducer being vertically offset from said third dipole transducer;

(d) said first and second dipole transducers dipoles being driven by a first electrical signal;

(e) said third and fourth dipole transducers being driven by a second electrical signal; and (f) said third dipole transducer being tilted with respect to a vertical axis and said fourth dipole transducer being tilted with respect to a vertical axis so that said third projection axis and said fourth projection axis intersect proximate said listening position.

3. The loudspeaker for use by a listener in a listening position as recited in claim 2, wherein said third and fourth dipole transducers are laterally offset from said first and second dipole transducers.

4. The loudspeaker for use by a listener in a listening position as recited in claim 1, further comprising:

(a) a video display located above said first dipole transducer and below said second dipole transducer; and (b) wherein said first and second dipole transducers are a center channel for said video display.

5. The loudspeaker for use by a listener in a listening position as recited in claim 1, further comprising:

(a) a video display located above said first dipole transducer and below said second dipole transducer; and (b) wherein said video display displays video corresponding to an audio signal carried in said single electrical signal.

6. The loudspeaker for use by a listener in a listening position as recited in claim 5, wherein said first dipole transducer and said second dipole transducer combine to form a phantom acoustic center channel image.

7. The loudspeaker for use by a listener in a listening position as recited in claim 1, wherein said first and second dipole transducers are positioned to time align the arrival of sound at said listening position.

8. A loudspeaker for use by a listener in a listening position, comprising:

(a) a first dipole transducer, having a first projection axis;

(b) a second dipole transducer, having a second projection axis;

(c) said second dipole transducer being vertically offset from said first dipole transducer;

(d) said first and second dipole transducers being driven by a single electrical signal;

(e) said listening position being horizontally offset from said first and second dipole transducers;

(f) said first dipole transducer and said second dipole transducer each being oriented so that a sum of sound pressure from said first and second dipole transducers is maximized at said listening position.

9. The loudspeaker for use by a listener in a listening position as recited in claim 8, further comprising:

(a) a third dipole transducer, having a third projection axis;

(b) a fourth dipole transducer, having a fourth projection axis;

(c) said fourth dipole transducer being vertically offset from said third dipole transducer;

(d) said first and second dipole transducers being driven by a first electrical signal;

(e) said third and fourth dipole transducers being driven by a second electrical signal; and (f) said third dipole and said fourth dipole transducers both being oriented so that a sum of sound pressure from said third and fourth dipole transducers is maximized at said listening position.

10. The loudspeaker for use by a listener in a listening position as recited in claim 9, wherein said third and fourth dipole transducers are laterally offset from said first and second dipole transducers.

11. The loudspeaker for use by a listener in a listening position as recited in claim 8, further comprising:

(a) a video display located above said first dipole transducer and below said second dipole transducer; and (b) wherein said first and second dipole transducers are a center channel for said video display.

12. The loudspeaker for use by a listener in a listening position as recited in claim 8, further comprising:

(a) a video display located above said first dipole transducer and below said second dipole transducer; and (b) wherein said video display displays video corresponding to an audio signal carried in said single electrical signal.

13. The loudspeaker for use by a listener in a listening position as recited in claim 12, wherein said first dipole transducer and said second dipole transducer combine to form a phantom acoustic center channel image.

14. The loudspeaker for use by a listener in a listening position as recited in claim 8, wherein said first and second dipole transducers are positioned to time align the arrival of sound at said listening position.

15. A loudspeaker for use by a listener in a listening position in a room having a floor, a ceiling, and a wall, comprising:

(a) a first dipole transducer, having a first projection axis;

(b) a second dipole transducer, having a second projection axis;

(c) said second dipole transducer being offset from said first dipole transducer;

(d) said first and second dipole transducers being driven in phase;

(e) said listening position being horizontally offset from said first and second dipole transducers;

(f) said first dipole transducer and said second dipole transducer being oriented so that a sum of direct sound pressure from said first and second dipole transducers is maximized at said listening position while sound pressure from said dipole transducers reflected from said floor, said ceiling, and said wall is minimized.

16. The loudspeaker for use by a listener in a listening position as recited in claim 15, further comprising:

(a) a third dipole transducer, having a third projection axis;

(b) a fourth dipole transducer, having a fourth projection axis;

(c) said fourth dipole transducer being vertically offset from said third dipole transducer;

(d) said first and second dipole transducers being driven by a first electrical signal;

(e) said third and fourth dipole transducers being driven by a second electrical signal, and (f) said third dipole transducer and said fourth dipole transducer being oriented so that a sum of direct sound pressure from said third and fourth dipole transducers is maximized at said listening position while sound pressure from said third and fourth dipole transducers reflected from said floor, said ceiling, and said wall is minimized.

17. The loudspeaker for use by a listener in a listening position as recited in claim 16, wherein said third and fourth dipole transducers are laterally offset from said first and second dipole transducers.

18. The loudspeaker for use by a listener in a listening position as recited in claim 15, further comprising:

(a) a video display located above said first dipole transducer and below said second dipole transducer; and (b) wherein said first and second dipole transducers are a center channel for said video display.

19. The loudspeaker for use by a listener in a listening position as recited in claim 15, further comprising:

(a) a video display located between said first and second dipole transducers; and (b) wherein said video display displays video corresponding to an audio signal carried in said single electrical signal.

20. The loudspeaker for use by a listener in a listening position as recited in claim 19, wherein said first dipole transducer and said second dipole transducer combine to form a phantom acoustic center channel image.

* * * * *